US007169208B2

(12) United States Patent
Campbell et al.

(10) Patent No.: US 7,169,208 B2
(45) Date of Patent: Jan. 30, 2007

(54) METHOD AND COMPOSITION FOR DISPERSING EXTRA-FINE NICKEL POWDER

(75) Inventors: Scott Thomas Campbell, Milton (CA); Thomas Francis Stephenson, Toronto (CA); Tajpreet Singh, Burlington (CA)

(73) Assignee: Inco Limited, Toronto (CA)

( * ) Notice: Subject to any disclaimer, the term of this patent is extended or adjusted under 35 U.S.C. 154(b) by 109 days.

(21) Appl. No.: 10/865,426

(22) Filed: Jun. 10, 2004

(65) Prior Publication Data

US 2005/0276716 A1 Dec. 15, 2005

(51) Int. Cl.
*B22F 1/00* (2006.01)
*B22F 3/12* (2006.01)

(52) U.S. Cl. ..... 75/252; 419/13; 419/14; 419/19; 419/32; 419/38

(58) Field of Classification Search ..... 75/252; 419/13, 14, 19, 32, 38
See application file for complete search history.

(56) References Cited

U.S. PATENT DOCUMENTS 3,510,292 A 5/1970 Hardy et al. ..... 75/5
3,580,519 A 5/1971 Klein et al. ..... 241/22
4,517,118 A * 5/1985 Stoetzer ..... 252/513
4,569,693 A 2/1986 Albrecht et al. ..... 75/252
5,578,238 A * 11/1996 Weiss et al. ..... 252/62.52
5,782,954 A 7/1998 Luk ..... 75/252
5,900,315 A 5/1999 Little ..... 428/405
6,316,100 B1 * 11/2001 Kodas et al. ..... 428/357
6,527,823 B2 * 3/2003 Moro ..... 75/246
2003/0001142 A1 * 1/2003 Kamikoriyama et al. ... 252/500

FOREIGN PATENT DOCUMENTS

CA 2055800 7/2001

OTHER PUBLICATIONS

Cabot Corporation Promotional Literature, CAB-O-SIL® TS-530, (date unknown), pp. 1-4.

* cited by examiner

*Primary Examiner*—Ngoclan T. Mai
(74) *Attorney, Agent, or Firm*—Edward A. Steen

(57) ABSTRACT

A composition for use with alloys including extra-fine nickel powder dispersed with a hydrophobic inorganic dispersant which is preferably high-purity silica treated with hexamethyldisilazane (fumed silica). The composition breaks and prevents the agglomeration of the nickel powder, thereby preventing weaknesses in alloys, like steel for example, formed with the nickel powder. A method for making an alloy with the composition includes mixing the nickel powder with other metals and/or nonmetals and the hydrophobic fumed silica to form an alloy blend, pressing the alloy blend, and sintering the alloy blend.

20 Claims, 11 Drawing Sheets

METHOD AND COMPOSITION FOR DISPERSING EXTRA-FINE NICKEL POWDER

FIELD AND BACKGROUND OF THE INVENTION

The present invention relates generally to the field of powder metallurgy and in particular to compositions protecting nickel powder from agglomeration as well as a method for producing these compositions.

The introduction of extra-fine nickel powder to the powder metallurgy (P/M) industry has been delayed primarily due to agglomeration of the nickel powder. Specifically, commercial use of extra-fine nickel powder has been restricted due to the formation of agglomerates during mixing with other metal powders such as iron. The problem typically arises in the postproduction stage, such as during packaging and transport. These nickel agglomerates cause defects, which could lead to premature failure of a pressed and sintered steel part. Such steel parts are typically used in a variety of applications such as automotive components.

The potential of improving properties such as hardenability and density in powder metallurgy steels could be accomplished via improved nickel distribution and diffusion. Agglomerates create two principal problems. First, areas of high nickel content promote the formation of soft Ni-rich austenitic regions. These soft phases are detrimental to hardenability. Second, areas of weakness result from large agglomerates due to a lack of homogeneity leading to problems in parts such as differential shrinkage during sintering.

In order to make extra-fine nickel powder more suitable for the powder metallurgy industry, a method of preventing agglomeration is needed.

One solution employed by the hardmetal and diamond tooling industry is the use of high shear mixing technology such as plough shear blenders. Laboratory results using medium or high shear blending processes (V-cone blender with intensifier bar) have successfully reduced the number of agglomerates in powder metallurgy steels. However, most production blending facilities do not have this type of process equipment and low shear (double cone blenders) cannot break up the agglomerates. The ferrous-based "press and sinter" industry typically has low shear mixing technology, such as double-cone blenders and is unlikely to spend the capital needed for new mixers. Also, there is some concern that high shear mixing may alter the properties of the iron-based powder mixture; particularly with the longer mixing times needed to break up agglomerates.

Thus, there is a need in the nickel powder metallurgy industry for an inexpensive means to prevent agglomeration of nickel powder, particularly in steel blends and alloys where nickel is mixed with iron.

The issue of agglomeration is not a new one. The problems faced by agglomeration in powders in general is described in the background of U.S. Pat. No. 3,580,519, which is incorporated herein by reference. This patent teaches a process of grinding finely divided powdered substances with finely divided hydrophobic silica, or a process of mixing a ground powdered substance with a mixture of finely divided hydrophobic and hydrophilic silicas.

Fumed silica is known to enhance flowability of a metal oxide, as disclosed in U.S. Pat. Nos. 4,569,693 and 5,782,954.

Furthermore, U.S. Pat. No. 5,900,315 describes the preparation of a powder product with a fumed silica, and in particular a toner composition. The toner composition includes resin particles, at least one colorant, and a charge modified metal oxide which includes a metal oxide treated with a cyclic silazane. The composition is mixed by conventional mixing techniques.

However, a treatment to reduce or prevent agglomeration of extra-fine nickel powder, or an alloy blend comprising extra-fine nickel powder has not been disclosed or suggested in the prior art, thereby explaining the current need for a means for preventing agglomeration of nickel powders, particularly in alloy steel blends.

SUMMARY OF THE INVENTION

It is an object of the present invention to provide a means for breaking down nickel agglomerates formed after packaging and during transport and preventing the formation of new agglomerates.

It is a further object of the present invention to provide an alloy blend without agglomeration thereby preventing weaknesses in the alloy produced from the alloy blend.

Accordingly, a composition and method are disclosed in which an inorganic hydrophobic dispersant is mixed with extra-fine nickel powder using low shear mixing technology, whereby nickel agglomerates are broken down and prevented in the future from forming. The extra-fine nickel powder and inorganic hydrophobic dispersant may also be mixed with other metals and/or nonmetals to produce alloys which do not have weaknesses attributable to agglomeration of nickel powder.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

The present invention comprises a composition of extra-fine nickel powder mixed with an inorganic hydrophobic dispersant and a method for making the composition. The inorganic dispersant may include ultrafine metal oxides (such as $SiO_2$, $Fe_3O_4$, NiO, $Al_2O_3$and $TiO_2$), carbides (such as TaC), or nitrides (such as BN or TiN) and combinations thereof.

For the purposes of this patent, the term "about" before a series of values shall be interpreted as applying to each value in the series unless noted to the contrary.

Extra-fine nickel powder is typically about 1–2 μm and ultrafine metal oxides, carbides and nitrides are typically about 100–500 nm.

The inorganic dispersant of the present invention is preferably a high-purity purity fumed silica which has been treated with a silyating agent to render the inorganic dispersant hydrophobic. The silyating agent of the present invention is preferably hexamethyldisilazane, but may also include other silyating agents such as trimethoxysilane. The treatment replaces many of the surface hydroxyl groups on the fumed silica with trimethylsilyl groups according to the following chemical reaction. The silyating agent reacts with surface moisture on the base silica and hydrolizes into two trimethylsilyl groups and ammonia. The trimethylsilyl groups react with the surface hydroxyl groups. The ammonia is removed prior to packaging. The trimethylsilyls react quickly with the isolated hydroxyl groups on the surface and, to a lesser extent, with some of the adjacent hydroxyl groups. This surface treatment removes the majority of the hydrogen bonding sites. This treatment makes the inorganic dispersant extremely hydrophobic. Since the treatment removes surface hydroxyl groups, the hydrophobic inorganic dispersant does not effectively thicken by hydrogen bonding.

There are a number of binding mechanisms that contribute to agglomeration. The forces most relevant to this problem are low-viscosity liquid binding, electrostatic forces, and intermolecular forces.

Figure 1:
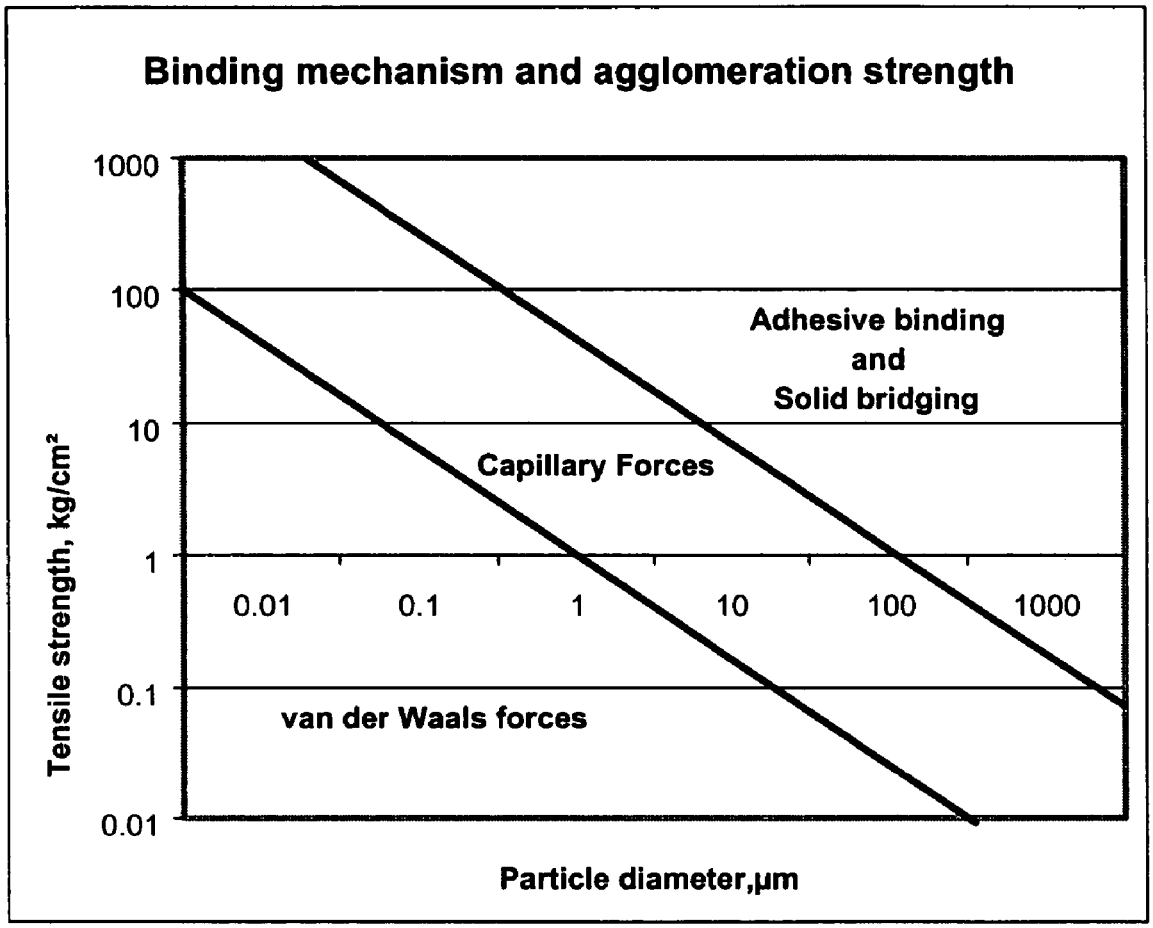
FIG. 1 is a chart which demonstrates how particle size and binding mechanisms relate to the strength of the interparticulate bonding force.

The chart in FIG. 1 demonstrates how particle size and binding mechanisms relate to the strength of the interparticulate bonding force. As particle size is decreased the force mechanism relies less on external interaction (compaction or adhesives) and more on internal attraction (static, surface tension or van der Waals). However, the change in the force mechanism by no means diminishes the strength of the bond. Capillary forces acting on the particles through hydrophilic nature of the fumed silica are reduced. The following equation aids in explaining how the ultrafine inorganic dispersant can also reduce the van der Waals forces.

$$F(D) = -\frac{A_{12}}{24H^2}\left(\frac{D_1 D_2}{D_1 + D_2}\right)$$

This shows that there are two variables that are capable of reducing the effect van der Waals forces. The first is to reduce the Hamaker coefficient ($A_{12}$). This can be accomplished by addition of an intervening medium that reduces the attractive forces well, increasing the distance between the two particles (H) can accomplish reduction of the forces. The inorganic dispersant therefore acts as a spacer, physically holding the particles apart.

The addition of inorganic dispersant to the powder prevents hard caking and greatly facilitates fluidization when use is resumed.

The recommended usage level for this purpose can be between about 0.01 to 1.0% by weight. For nickel powder however, it has been determined from the results below that the optimal amount of fumed silica in the composition of the present invention ranges from about 0.25% to 0.5% by weight. However, other suitable amounts range from about 0.05% by weight to 1% by weight depending on a variety of factors including the desired application.

The method for preparing the composition includes the steps of treating a high-purity inorganic dispersant with a silyating agent to render the dispersant hydrophobic, mixing the hydrophobic inorganic dispersant with the extra-fine nickel powder between about 20 and 80 minutes and most preferably between about 30 and 40 minutes in a shearing apparatus, preferably a low shear blender or similar device.

Furthermore, the present invention also includes an alloy blend composition comprising a mixture of nickel powder, hydrophobic inorganic dispersant, and another metal and/or non-metal. A method of forming an alloy from the blend composition includes the steps of mixing between about 20 and 80 minutes, and most preferably between about 20 and 40 minutes in a low shear V-cone, double cone or Turbula® type blender, pressing, and sintering the blend composition at a high temperature. Metal chains can be added to the low shear blender to increase the shear.

One exemplary embodiment of an alloy blend is a composition mixture of nickel powder, hydrophobic fumed silica, carbon, and iron powder, which is pressed and sintered at a high temperature to form steel.

Below are several studies which have conducted that exemplify the benefits of the compositions and methods of the present invention.

EXAMPLE 1

Two samples of extra-fine nickel powder were prepared each containing 80 g powder. The nickel powder was obtained from Inco Limited under the trademark Inco® T110. The first sample was blended for 40 minutes with 0.5% hydrophobic fumed silica provided from Cabot Corporation under the trademark Cab-O-Sil® TS-530. The second sample was blended for 40 minutes with no additions. The blending was done in a Turbula® type blender. Because silica is added at 0.5% of the nickel content, as nickel content in P/M steels is typically <4%, the silica levels of the final powder metallurgy steel are less than 200 ppm. The treated sample had significantly reduced agglomeration. The untreated sample showed the agglomeration typically seen from the INCO® T110 nickel powders.

After the blending, the material was screened in the rotary tapping sieve shaker for 2 minutes. The powder was screened over a 120-mesh screen (125 μm). The treated powder passed 98% (1.4 g +120 mesh; 76 g −120 mesh) and the untreated powder passed only 25% (60 g +120 mesh; 20 g −120 mesh). Previous work has limited any screening of this powder to using 35 mesh screens due to the large losses in the oversize fraction.

The majority of treated nickel powder was still fine with only a few agglomerates, while the untreated nickel powder was mostly composed of large granules.

EXAMPLE 2

In another study four factors were tested: blending time, composition of fumed silica additions, mixing shear, and use of hydrophobic versus hydrophilic fumed silica.

Powder was examined via screening through a 125 μm screen in the rotary tapping sieve shaker screen shaker for 4 minutes. The percentage of oversized material was used to judge the degree of agglomeration.

The agglomeration tendencies of as-received material showed ~60% of the material did not pass through the screen and was categorized as oversized material. In general, as blending time and silica additions were increased the amount of oversized material decreased. The amount of improvement plateaued after 40 minutes of blending time and 0.25 wt % fumed silica addition.

Two types of fumed silica were acquired from Cabot Corporation. The first type of fumed silica, available under the trademark CAB-O-SIL® M5, was uncoated and hydrophilic in nature. The second type of fumed silica, CAB-O-SIL® TS530, is available with a silyating organic coating to render the material hydrophobic. One test with CAB-O-SIL® M5 was done at 0.5 wt % addition for 40 minutes; the oversize fraction was 57%. The hydrophobic nature of the inorganic dispersant is a critical parameter affecting agglomeration.

To see the effect of higher energy mixing on blending time and fumed silica additions, samples were repeated with Ni pellets added to the mixing vessel. The pellets added were 2–6 mm in diameter and were added to equal ~40% of the INCO® T110 nickel powder mass. Significant reduction in the oversized fraction was seen in the results. Analysis of particle size distribution showed that the diameter D (0.5) was very consistent between the powders; as-received, blended, and blended with pellet loading. This observation along with photomicrographs from a scanning electron microscope (SEM) establishes that there is little in the way of particle deformation from the pellet loading.

With respect to blending time, the INCO® T110 nickel powder was screened −125 μm as-received to determine the agglomeration tendencies of the material. The results are presented in Table 1 below.

TABLE 1

| As-received | | | | |
|---|---|---|---|---|
| Lot Number | Oversize g | Undersize g | Total g | Oversize % |
| A | 31.3 | 19.2 | 50.5 | 62.0 |
| B | 27.9 | 21.6 | 49.5 | 56.4 |

All blending was done in a 125 ml glass jar in the Turbula® type blender. The blends consisted of 100 g of INCO® T110 nickel powder (Lot #B) with 0.5 wt % of Cab-O-Sil TS530 fumed silica. The blending was done for 1, 10, 20, 40, 80, 120 minutes. After blending, 50 g of mixture was screened through a 125 μm screen using the rotary tapping sieve shaker for four minutes.

Figure 2:
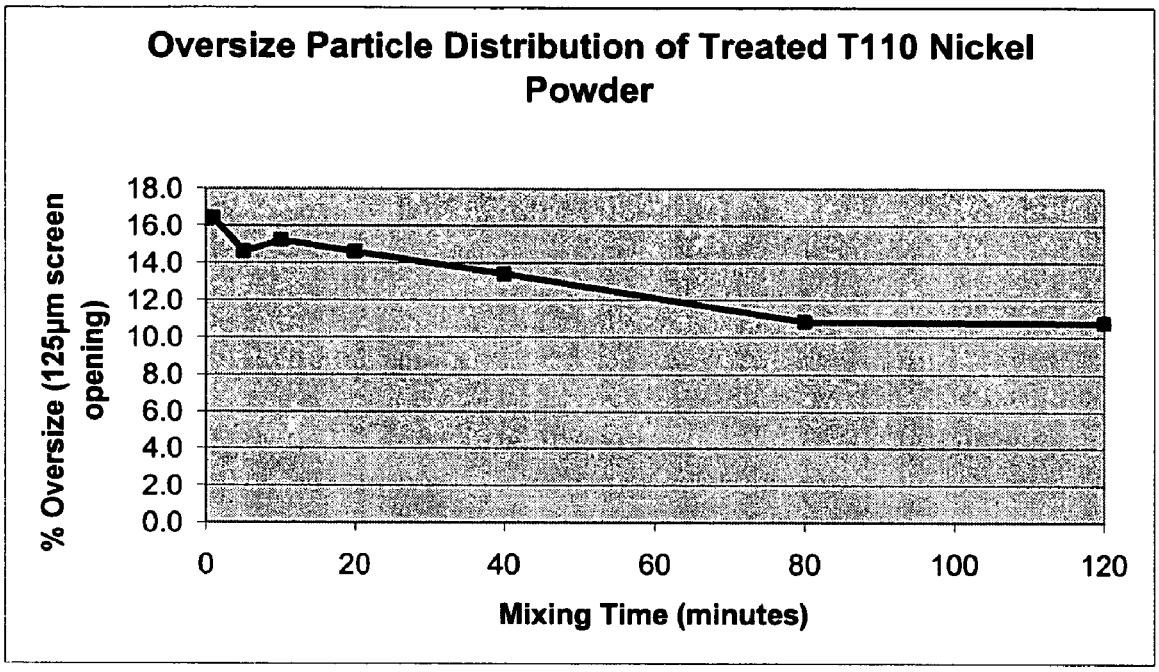
FIG. 2 is a graph which shows oversize particle distribution plotted against mixing time.

Table 2 shows the results. FIG. 2 shows the oversize particle distribution plotted against mixing time.

TABLE 2

| Time min | oversize g | under size g | total g | oversize % |
|---|---|---|---|---|
| 1 | 8.2 | 41.8 | 50.0 | 16.4 |
| 5 | 7.3 | 42.7 | 50.0 | 14.6 |
| 10 | 7.6 | 42.4 | 50.0 | 15.2 |
| 20 | 7.3 | 42.7 | 50.0 | 14.6 |
| 40 | 6.7 | 43.3 | 50.0 | 13.4 |
| 80 | 5.4 | 44.4 | 49.8 | 10.8 |
| 120 | 5.5 | 45.5 | 51.0 | 10.8 |

The simple addition of hydrophobic fumed silica even for a minute significantly reduced agglomeration tendency. No improvement was seen after 80 minutes. A cross between time and agglomeration reduction appears reasonable at about 40 minutes.

Figure 3:
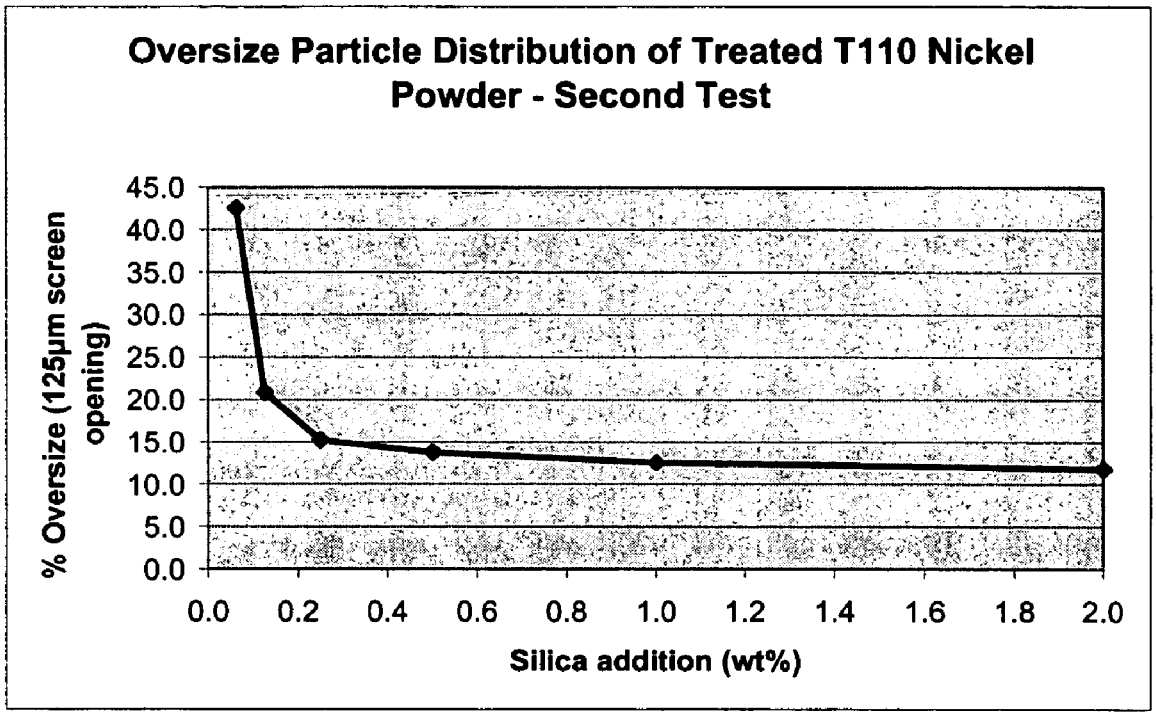
FIG. 3 is a graph which shows oversize particle distribution of treated extra-fine INCO® T110 nickel powder plotted against percent by weight of silica addition.

With respect to fumed silica addition, all processing was done as described above, with the exception of blending time which was held at 40 minutes for all tests. The fumed silica additions were done between 0.063 and 2 wt %. The results are displayed in table 3 and FIG. 3.

TABLE 3

| addition % | oversize g | under size g | total g | oversize % |
|---|---|---|---|---|
| 0.063 | 21.3 | 28.7 | 50.0 | 42.6 |
| 0.125 | 10.4 | 39.5 | 49.9 | 20.8 |
| 0.250 | 7.6 | 42.3 | 49.9 | 15.2 |
| 0.500 | 6.9 | 43.1 | 50.0 | 13.8 |
| 1.000 | 6.3 | 43.7 | 50.0 | 12.6 |
| 2.000 | 5.9 | 43.9 | 49.8 | 11.8 |

Even a very small amount of fumed silica at 0.063 wt % significantly reduced the agglomeration tendency of the nickel powder. The optimum addition was between about 0.25 and 0.5 wt %. Any higher additions had minimal improvement.

With respect to mixing shear, a sampling of conditions from the previous testing was repeated adding 40 g of nickel pellets to the blending jar. This simulated conditions used in the hard metals industry where metal chains are sometimes added to increase mixing shear in Turbula® type blender.

Figure 4:
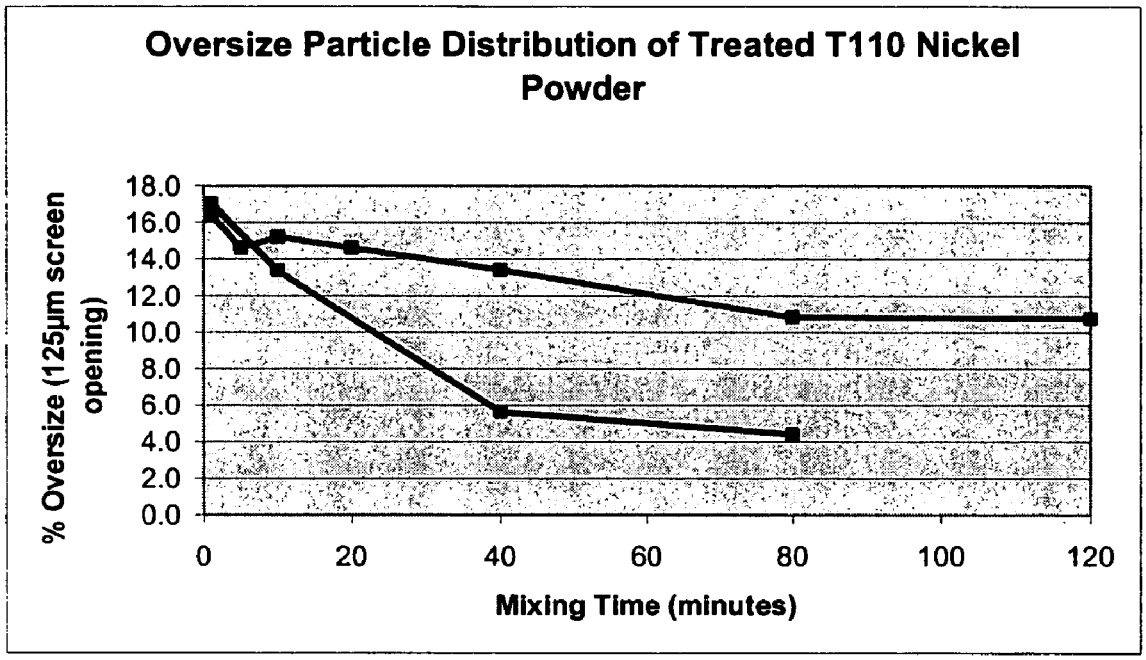
FIG. 4 is a graph which shows oversize particle distribution of treated extra-fine INCO® T110 nickel powder plotted against mixing time.

The 40 g of nickel pellets with 0.5 wt % TS530 fumed silica addition ranged in size from 2–6 mm. Table 4 below shows the results of this study. FIG. 4 shows a comparison of versize particle distribution versus blending time. The two lines compare how the added shear affects agglomeration.

TABLE 4

| Time min | oversize g | under size g | total g | oversize % |
|---|---|---|---|---|
| 1 | 8.2 | 41.8 | 50.0 | 16.4 |
| 5 | 7.3 | 42.7 | 50.0 | 14.6 |
| 10 | 7.6 | 42.4 | 50.0 | 15.2 |
| 20 | 7.3 | 42.7 | 50.0 | 14.6 |
| 40 | 6.7 | 43.3 | 50.0 | 13.4 |
| 80 | 5.4 | 44.4 | 49.8 | 10.8 |
| 120 | 5.5 | 45.5 | 51.0 | 10.8 |
| | with pellet loading of 40% of mass | | | |
| 1 | 8.5 | 41.4 | 49.9 | 17.0 |
| 10 | 6.7 | 43.4 | 50.1 | 13.4 |
| 40 | 2.8 | 47 | 49.8 | 5.6 |
| 80 | 2.2 | 47.7 | 49.9 | 4.4 |

Table 5 below shows the results of the addition of various amounts of fumed silica as compared to the oversize percentage after 40 minutes of mixing.

TABLE 5

| addition % | oversize g | under size g | total g | oversize % |
|---|---|---|---|---|
| 0.063 | 21.3 | 28.7 | 50.0 | 42.6 |
| 0.125 | 10.4 | 39.5 | 49.9 | 20.8 |
| 0.250 | 7.6 | 42.3 | 49.9 | 15.2 |
| 0.500 | 6.9 | 43.1 | 50.0 | 13.8 |
| 1.000 | 6.3 | 43.7 | 50.0 | 12.6 |
| 2.000 | 5.9 | 43.9 | 49.8 | 11.8 |
| | with pellet loading of 40% of mass | | | |
| 0.125 | 13.9 | 36 | 49.9 | 27.9 |
| 0.25 | 6.2 | 43.8 | 50.0 | 12.4 |
| 0.5 | 2.8 | 47 | 49.8 | 5.6 |
| 1 | 1.2 | 48.7 | 49.9 | 2.4 |

Figure 5:
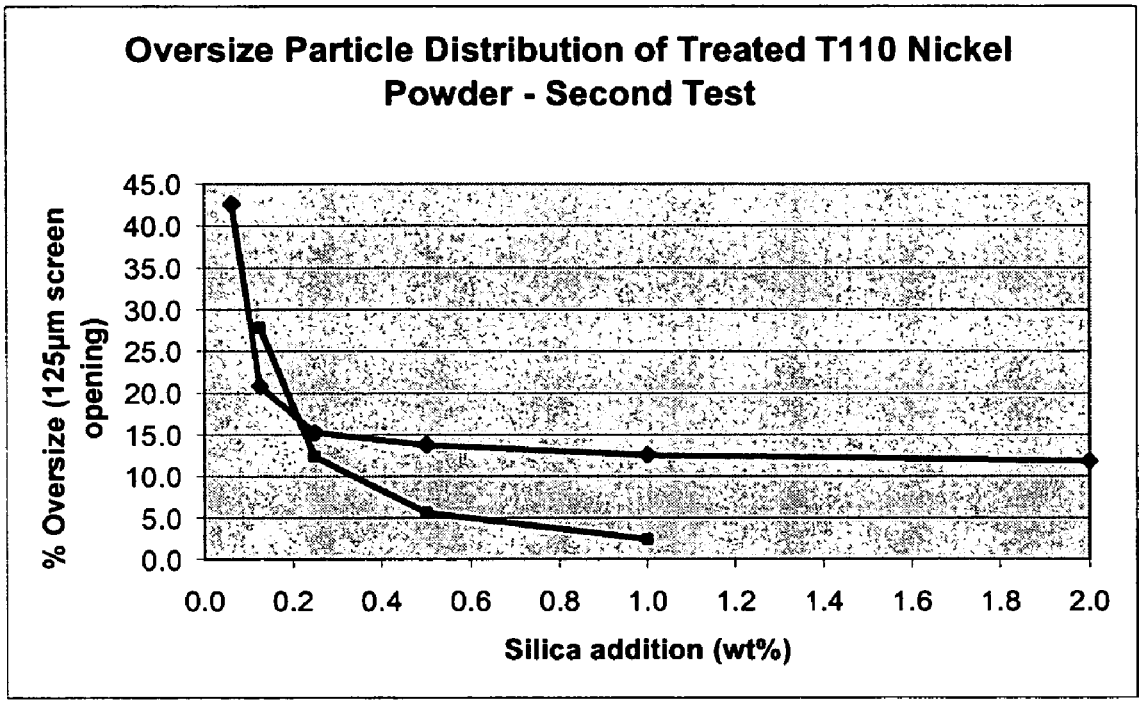
FIG. 5 is a graph which shows oversize particle distribution of treated extra-fine INCO® T110 nickel powder plotted against percent by weight of silica addition after mixing shear was increased.

FIG. 5 shows how the added mixing shear can affect the agglomeration tendencies of samples produced with various fumed silica additions.

In both cases the increased mixing shear has decreased the agglomeration tendencies of the powder. Increased shear could be used to reduce mixing time or required additives. It could also be considered to increase yields.

A consideration with using this type of technique is the possibility of causing flattening or flaking of the powder. Samples of the 0.5 wt % addition of fumed silica were blended for various times and then screened to −125 μm prior to submitting for particle size dermination via a Malvern™ particle size analyzer. The D(50) are noted below in Table 6.

TABLE 6

| Malvern Particle Size Analysis - D(50) | | | | | | | |
|---|---|---|---|---|---|---|---|
| | | | | | With Pellets | | |
| | | No Pellets | | | | 40 | 80 |
| Sample | Received | 10 min | 40 min | 80 min | 10 min | min | min |
| D(50) | 1.65 | 1.72 | 1.72 | 1.74 | 1.75 | 1.72 | 1.72 |

From these tests and SEM photomicrographs no deformation can be seen.

With respect to the advantage of hydrophobic fumed silica over hydrophilic silica, the following test was performed.

CAB-O-SIL® M5 and CAB-O-SIL® TS530 from Cabot Corp. were compared.

CAB-O-SIL® M5 fumed silica contributions modifies product flow properties by building a three-dimensional network which alternately forms and disrupts in response to the degree of shear forces present, thereby controlling flow characteristics. CAB-O-SIL® TS-530 treated fumed silica is a high purity silica that has been treated with hexamethyldisilazane. The treatment replaces many of the surface hydroxyl groups on the fumed silica with trimethylsilyl groups, rendering the silica extremely hydrophobic.

Figure 6:
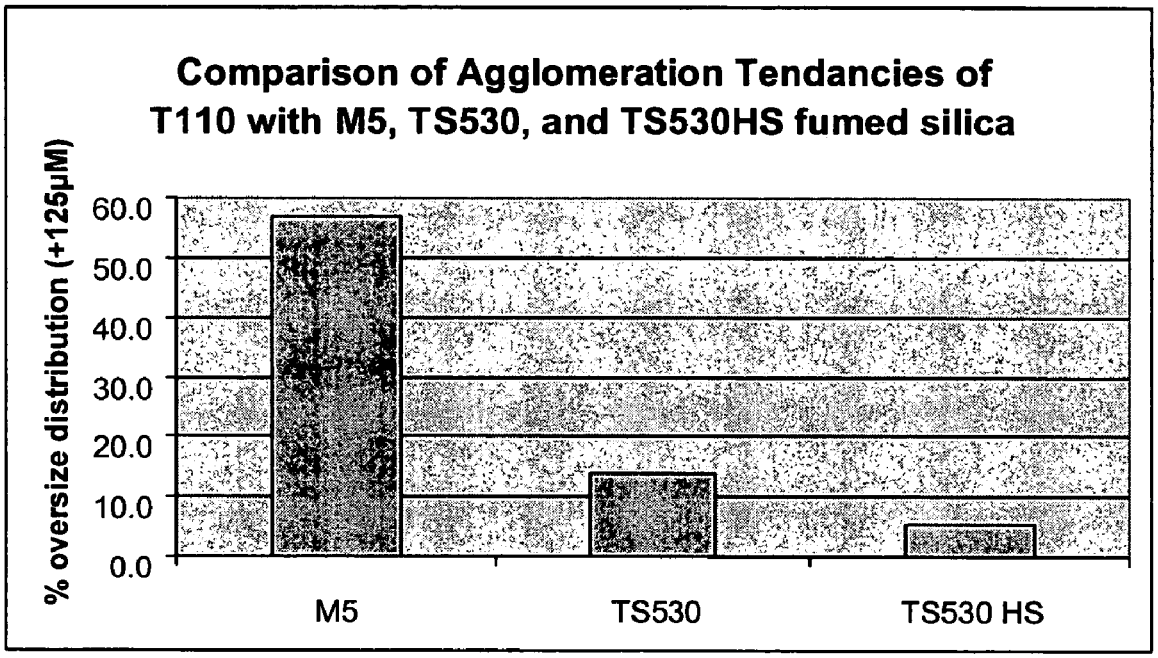
FIG. 6 is a bar graph that shows a comparison of the percent oversize distribution for powder metallurgy compositions containing hydrophilic Cab-O-Sil®M5 and hydrophobic Cab-O-Sil® TS530 fumed silica.

The primary difference between the two products is the organic coating on the CAB-O-SIL® TS-530 which renders the material hydrophobic as opposed to the very hydrophilic nature of the untreated fumed silica. A sample containing 0.5 wt % CAB-O-SIL® M5 fumed silica was produced using the procedure as the above samples. FIG. 6 shows a comparison of the percent oversize distribution for hydrophilic CAB-O-SIL® M5 and hydrophobic CAB-O-SIL® TS530 fumed silica. The hydrophobic nature of the CAB-O-SIL® TS530 fumed silica as a dispersant is very important variable in the agglomeration prevention of INCO® T110 nickel powder.

EXAMPLE 3

A blend of treated INCO® T110 nickel powder, iron powder, graphite, and Acrawax® C was blended for 30 minutes.

A comparison of screening characteristics between treated and untreated INCO® T110 nickel powder found 4% of the material did not pass through a 250 μm screen opening. The treated material passed 100% of the material through the opening.

EXAMPLE 4

Three sets of steel blends were prepared. Each blend contained a mixture of 4% by weight nickel, 0.5% by weight carbon, and iron as the remaining component of the mixture. In the powder metallurgy field, this type of blend is referred to as Metal Powders Industries Federation Designation FN-0405 P/M steel blend. These three samples only differed in that the first sample contained extra-fine nickel powder (D50 diameter=1.5 micron) treated with hydrophobic fumed silica, the second sample contained extra-fine nickel powder that was not treated with any fumed silica, and the third sample contained standard grade nickel powder (D50 diameter=8 micron) that was also not treated with any fumed silica. INCO® T110 extra-fine nickel powder was used as in the above studies. The standard grade nickel powder is available from Inco Limited under the tradename T123.

The three steel blend samples were then pressed, sintered and tested. All samples received the same preparations with the exception of the addition of fumed silica.

The sample preparation and testing procedures used for this test work are now more precisely described as follows.

Blending: All powders were blended in 1 kg batches using the following ratios to create a FN-0405 P/M steel with 0.75 wt % Acrawax® C for lubrication:

40 g of Ni powder, 6 g of graphite, 7.5 g of Acrawax® C and Balance Atomet® 1001 Fe powder.

Ni Powders were INCO® T110 nickel powder and INCO® T123 nickel powder.

All blends were mixed for 30 minutes in a Turbula® type blender.

Preparation of the fumed silica treated INCO® T110 nickel powders involved the blending of 0.5 wt % fumed silica (CAB-O-SIL® TS530) with nickel powder (100 g INCO® T110 nickel powder/0.5 g fumed silica) and mixing for 30 minutes in the Turbula® type blender.

Pressing: Two sample geometries were pressed: 1) a transverse rupture strength (TRS) specimen and 2) a flat dog bone tensile specimen. These samples were prepared to Metal Powder Industries Federation Standards 41 and 10 respectively.

TRS samples weighed 18 g and tensile samples were 16 g.

Each sample was pressed to 550 MPa (40 t.s.i.). For TRS samples this equated to a load of 25 tons ($2.3\times10^5$N) and the load for the tensile bar was 40 tons ($3.5\times10^5$N).

Figure 7:
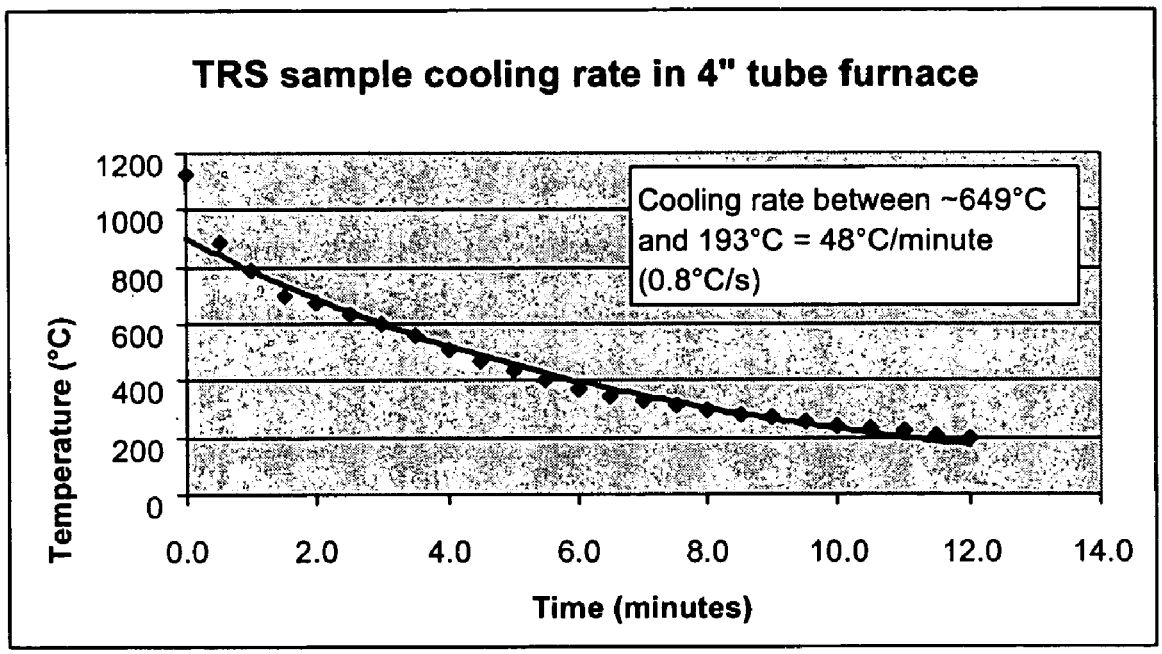
FIG. 7 is a graph plotting temperature versus time to show typical cooling rates during the process of sintering.

Sintering: All samples were batch sintered for 30 minutes at 1120° C. The furnace atmosphere was 90% $N_2$:10% $H_2$. The samples were drawn into the cooling zone for 30 minutes of cooling. FIG. 7 demonstrates the typical cooling rates. A 1/16" (1.6 mm) type 'K' thermocouple was embedded in the TRS bar with the cooling rate monitored.

After the three samples were prepared and processed, the following properties of the samples were evaluated.

Powder Properties:

Powder flow rate: Determination of green density followed Metal Powder Industries Federation Standard 03. Fifty grams of the blended FN-0405 was placed in a Hall™ low apparatus and the time for the 50 g to exit through the bottom hole was measured giving a measurement in s/50 g.

Apparent Density: Determination of green density followed Metal Powder Indutries Federation Standard 04. The blended FN-0405 material was placed in the Hall flow appratus and allowed to flow into the 25 $cm^3$ cup. The powder overflows the cup and then the cone is carefully scraped off such that the powder is filled to the top of the cup.

Screening:

Green Properties:

Green Density: Determination of green density followed Metal Powder Industries Federation Standard 42. Samples were weighed as pressed (A) and then submerged in an oil bath for 60 minutes under vacuum. The samples were then reweighed as impregnated (B). The last mass was determined by placing the samples in a basket submerged in water (C). The density of water ($\rho_w$) was measured. The following equation is used to calculate density.

$$P_8 = \frac{A\rho_w}{(B-C)}$$

Green Strength: Determination of green strength followed Metal Powder Industries Federation Standard 15. The sample is placed in a three-point test jig in the tensile machine. The span is set at 25.4 mm (P). The sample is measured for thickness (t) and width (W). Test speed for this test is 1 mm/minute. The maximum load (L) is noted and the following equation is used to calculate the strength.

$$S = \frac{3PL}{2t^2W}$$

Sintered Properties:

Sintered Density: Determination of sintered density followed Metal Powder Industries Federation Standard 42. Samples were weighed as pressed (A) and then submerged in an oil bath for 60 minutes under vacuum. The samples were then reweighed as impregnated (B). The last mass was determined by placing the samples in a basket submerged in water (C). The water temperature needs to measure to determine the density of the water ($\rho_w$). The following equation is used to calculate density.

$$\rho_8 = \frac{A\rho_w}{(B-C)}$$

Sintered Transverse Rupture Strength: Determination of transverse rupture strength followed Metal Powder Industries Federation Standard 15. The sample is placed in a three-point test jig in the tensile machine. The span is set at 25.4 mm (P). The sample is measured for thickness (t) and width (W). Test speed for this test is 1 mm/minute. The maximum load (L) is noted and the following equation is used to calculate the strength.

$$S = \frac{3PL}{2t^2W}$$

Sintered Tensile Strength: Determination of tensile strength followed Metal Powder Industries Federation Standard 10. Samples were of a flat, dog bone geometry. Both thickness and width within the gauge length was measured prior to testing. The test speed was 2 mm/minute.

Dimensional Change: Determination of dimensional change followed Metal Powder Industries Federation Standard 44. After sintering the samples are measured on the Checkmatic® dimensional comparator. The measurements are taken along the length of a TRS test bar between two fixed posts after calibration precision gage blocks. The result is calculated using the following formula with die size ($L_D$) and measured size ($L_S$).

$$\text{Dimensional change, \%} = \frac{L_S - L_D}{L_D} \times 100$$

Apparent Hardness: Determination of apparent hardness followed Metal Powder Industries Federation Standard 43. TRS samples were measured five times and averaged using the HRB scale.

Other Analyzed Properties—Distribution and Diffusion:

The analysis of the samples also focused on distribution, which was determined using EDS and creating a nickel x-ray map of the polished surface. The x-ray map provides a qualitative image to aid in visualizing the location of Ni.

Diffusion was analyzed as follows. For each steel, 3 representative fields were analyzed. In each field all of the "noticeable" Ni-rich areas (NRA) were analyzed for compostion via Energy Dispersive Spectrometry (EDS) and the area was measured via a manual grid method. This method involved placing a transparent grid, scaled to the Scanning Electron Microscope (SEM) micron bar, on top of the SEM micrograph. The data generated was approximate due to the selection of a limited number of fields and "noticeable" NRAs in the fields; some less visible and smaller sized NRAs may have been passed over. As well, the data was based on a 2-D approximation of irregular-shaped 3-D NRAs. Overall, this method was sufficient for giving reliable approximate values.

The % Ni undiffused, the % of Ni that has not gone into solution with the steel matrix, was calculated by:

$$\%\ \text{Ni undiffused} = \frac{[(\%\ \text{Ni}\ NRA\ 1)(\text{Area of}\ NRA\ 1) + (\%\ \text{Ni}\ NRA\ 2)(\text{Area of}\ NRA\ 2) + \ldots]}{((\text{Total field area} - \text{Porosity area})(2\%\ \text{Ni in steel}))}$$

$$\%\ \text{Ni undiffused} = \frac{\Sigma_{(i=1)} = (\%\ \text{Ni}\ NRA)_i(\text{Area of}\ NRA)_i}{(\text{Total Metal Area})(0.02)}$$

The "Total Metal" area represents the difference between the field area and the porosity area. An EDS element calculator showed that Ni content in the Fe matrix was ~0% throughout the samples. This was due to the sensitivity of the calculator, which only detects values for Ni greater than ~0.5%. Therefore, any Ni not found in the NRAs has diffused into the Fe matrix; the higher the % undiffused Ni value, the less Ni that has diffused into the matrix.

Ni particle agglomeration was calculated by:

Ni particles/Ni-rich=Area of Ni in NRA/Area of one Ni particle

The area of one T123 particle is 50.2 um (D=8 um) and one T110 particle is 1.8 um (D=1.5 um).

The Results:

The results of this investigation have shown that P/M steel FN-0405 with INCO® T110 nickel powder treated with fumed silica has the following improvements over T123 nickel powder containing FN-0405 P/M steels:

Powder flow rate: 27% improvement

Green properties: density (+0.6%) and strength (+3%)

Dimensional Change: 100% increase in shrinkage with a coefficient of variation of 2 compared to 18 for T123 containing blends Sintered properties: TRS strength (+2%), Tensile Strength (+20%), and apparent hardness (+6%)

All treated INCO® T110 nickel powder samples outperformed untreated INCO® T110 nickel powders The following tables provide the mean values of test results.

Powder blend properties are summarized in Table 7 below.

TABLE 7

Powder Blend Properties

| Sample | Apparent Density g/cm$^3$ | Powder Flow rate s/50 g | +125 μm g | +250 μm g |
|---|---|---|---|---|
| TT110 | 3.02 | 32.3 | 29.0 | 0 |
| T110 | 3.04 | 38.5 | 30.1 | 1.28 |
| T123 | 3.07 | 44.1 | | |

Figure 8:
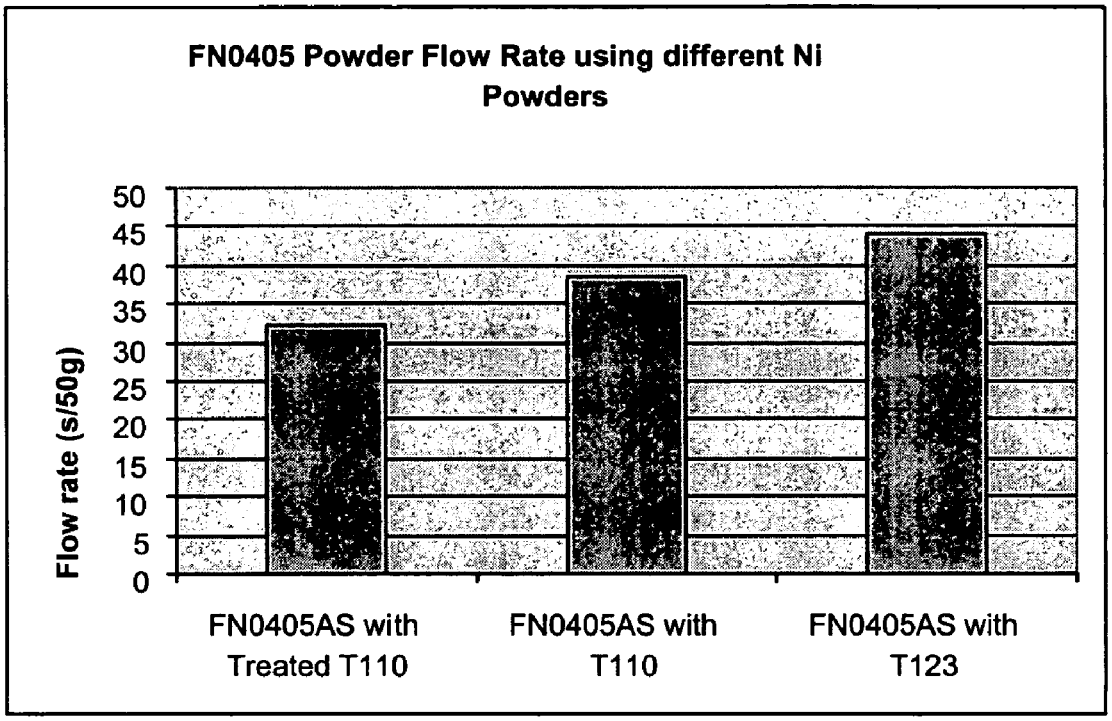
FIG. 8 is a bar graph comparing powder flow rates for steel blends comprising extra-fine nickel powder treated with fumed silica, extra-fine nickel powder not treated with fumed silica, and standard grade nickel powder also not treated with fumed silica.

Density and flow rate measurements are averages of three samples. A powder low rate comparison is shown in the bar graph in FIG. 8.

Green properties are summarized below in Table 8.

TABLE 8

Green properties pressed at 550 MPa

| Sample | Mass g | Density g/cm$^3$ | Thickness mm | TRS MPa |
|---|---|---|---|---|
| TT110 | 18.002 | 7.016 | 6.347 | 11.2 |
| T110 | 17.941 | 6.977 | 6.325 | 10.4 |
| T123 | 17.993 | 6.975 | 6.346 | 10.9 |

Mass and thickness are averages of 20 samples. Density and TRS are averages of 5 samples.

Sintered properties are summarized below in Table 9.

TABLE 9

Sintered properties

| Sample | Density g/cm$^3$ | Delta Length % of die size | Coefficient of Variation for Delta Length | TRS MPa | Tensile MPa | Apparent Hardness HRb |
|---|---|---|---|---|---|---|
| TT110 | 7.101 | −0.253 | 2.37 | 888 | 517 | 84 |
| T110 | 7.079 | −0.222 | 6.75 | 773 | 439 | 77 |
| T123 | 7.053 | −0.126 | 18.2 | 868 | 431 | 79 |

Delta length is an average of 10 measurements. Density, tensile, and hardness values are an average of 5 samples. TRS is an average of four measurements.

The carbon analyses for TT110, T110 and T123 are respectively 0.53, 0.66 and 0.49% by weight.

Figure 9:
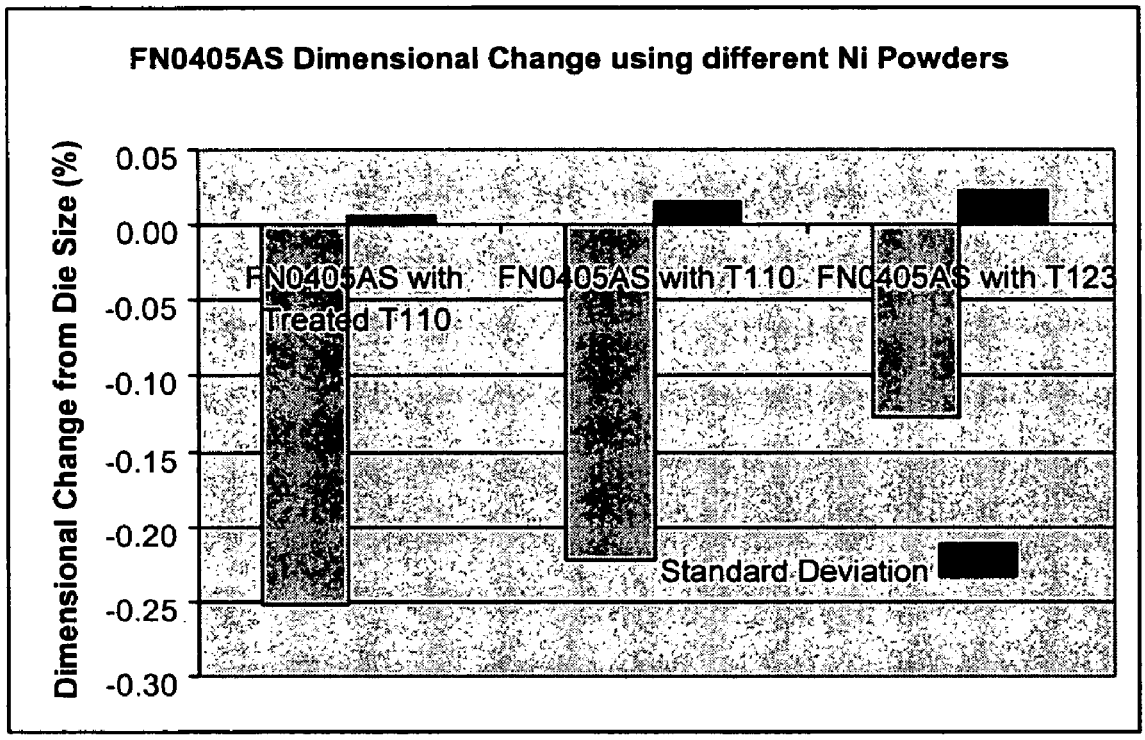
FIG. 9 is a bar graph comparing dimensional change from die size for steel blends comprising extra-fine nickel powder treated with fumed silica, extra-fine nickel powder not treated with fumed silica, and standard grade nickel powder also not treated with fumed silica.
Figure 10:
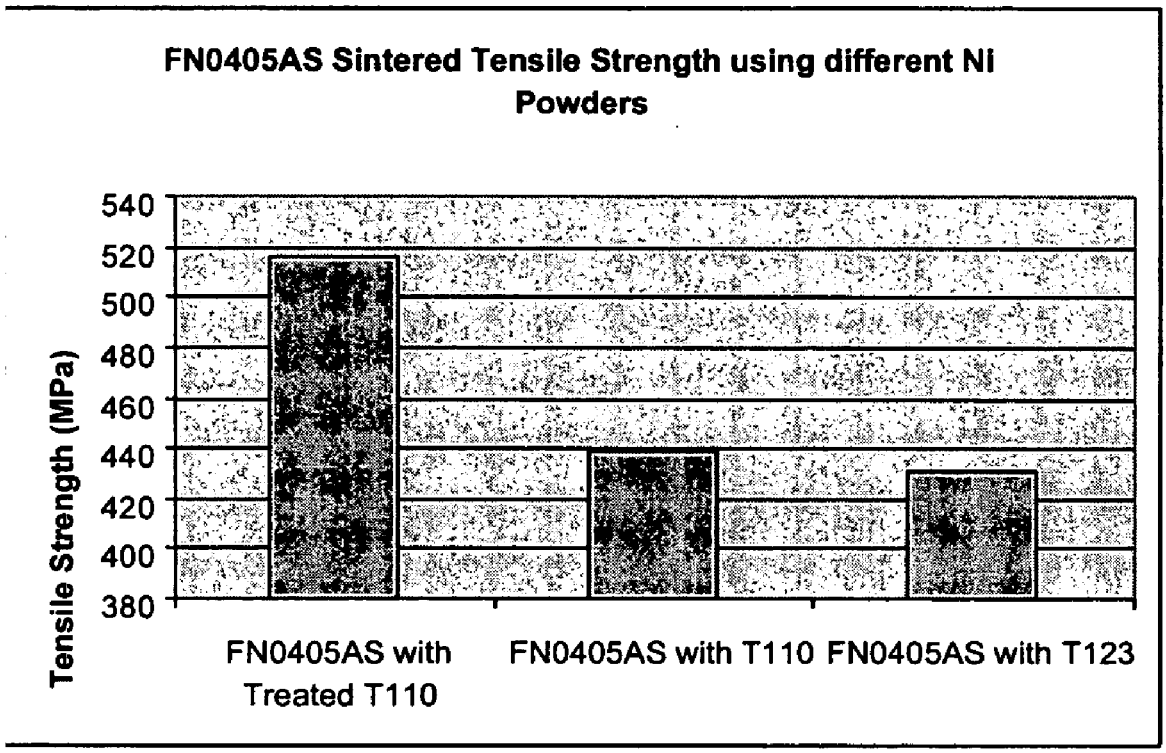
FIG. 10 is a bar graph comparing sintered tensile strength for steels made from blends comprising extra-fine nickel powder treated with fumed silica, extra-fine nickel powder not treated with fumed silica, and standard grade nickel powder also not treated with fumed silica.
Figure 11:
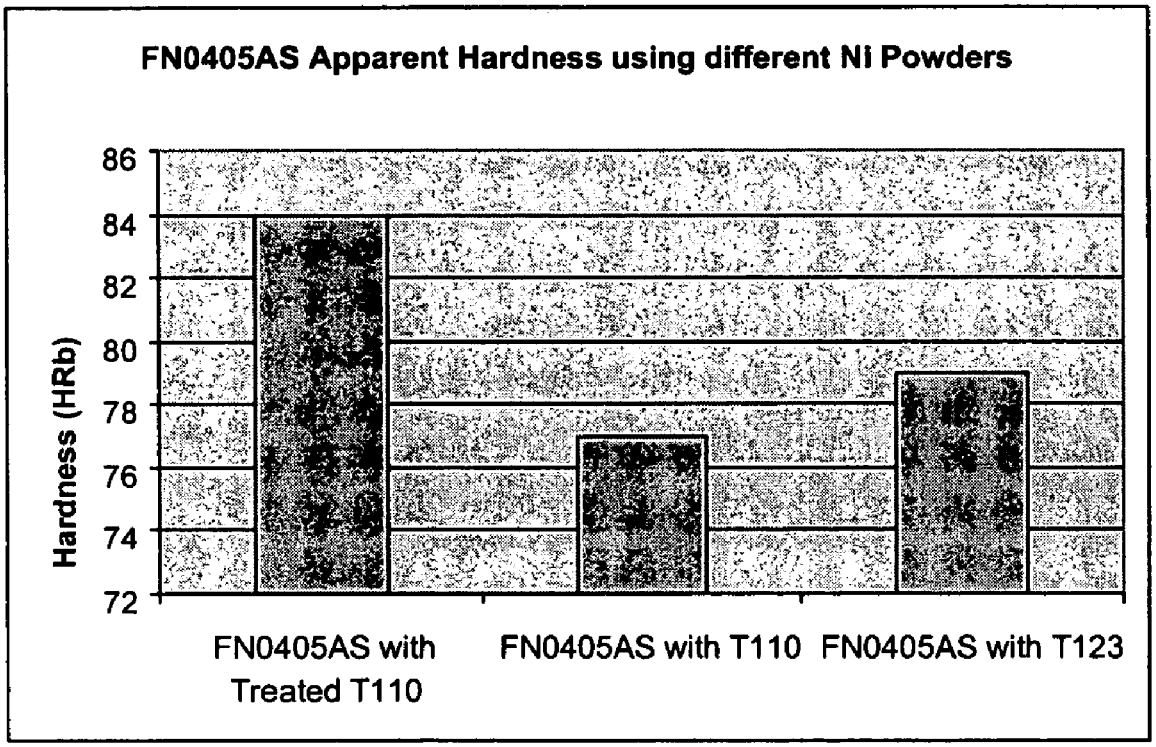
FIG. 11 is a bar graph comparing apparent hardness for steels made from blends comprising extra-fine nickel powder treated with fumed silica, extra-fine nickel powder not treated with fumed silica, and standard grade nickel powder also not treated with fumed silica.

Some of the results of physical testing are excerpted in FIGS. 9–11 with a comparison of improvements in dimensional change, tensile strength, and apparent hardness for TT110 blends against blends using untreated T110 and T123.

The distribution results of the testing are as follows.

In order to visualize the nickel distribution without any diffusion, samples were pressed and sintered for 5 minutes at 1065° C.

In order to estimate the number particles in an agglomerate, the size of the nickel region is estimated and the Ni content is measured using EDS. The Ni content is divided by the area of the nickel rich region to obtain an area of Ni particle size equivalent. This is then divided by the cross sectional area of a nickel particle (T123=50 μm$^2$; T110=1.8 μm$^2$). Table 10 below shows the mean number of particles/Ni rich area in each of the fields and average of Ni.

TABLE 10

Mean number of nickel particles/agglomerate and area of Ni equivalent

| Sample | Field 1 | Field 2 | Field 3 |
|---|---|---|---|
| TT110 | 11.4/20 μm$^2$ | 8.7/16 μm$^2$ | 9.7/17 μm$^2$ |
| T110 | 4.1/7 μm$^2$ | 97.7/176 μm$^2$ | 7.1/13 μm$^2$ |
| T123 | 0.40/28 μm$^2$ | 0.98/48 μm$^2$ | 0.71/35 μm$^2$ |

Even though there are more particles per agglomerate with T110 nickel powder, the overall area containing Ni is less than with discrete distribution of T123 nickel powder. Thus there is a better distribution of the particles with T110.

The main benefit of using T110 nickel powder has been an increase in diffusion that results from the smaller primary particle size. In order have a better indication of what the difference in diffusion properties between T110 and T123 may be a technique was developed for analyzing SEM images to estimate diffusion. The technique for analyzing diffusion is described above along with all necessary formulas.

The results of the analysis are as follows:

TABLE 11

Diffusion calculations for steel blend with T123 nickel powder

| Ni-rich area | % Ni | $\mu m^2$ total | $\mu m^2$ Ni | Particles/Ni-rich area |
|---|---|---|---|---|
| 1 | 21.5 | 116 | 25 | 0.50 |
| 2 | 25.8 | 196 | 51 | 1.01 |
| 3 | 37.9 | 276 | 105 | 2.08 |
| 4 | 15.7 | 160 | 25 | 0.50 |
| 5 | 12.3 | 132 | 16 | 0.32 |
| 6 | 9.9 | 88 | 9 | 0.17 |
| 7 | 21.7 | 80 | 17 | 0.35 |
| 8 | 13.5 | 100 | 14 | 0.27 |
| 9 | 12.8 | 80 | 10 | 0.20 |

| | |
|---|---|
| Field ($\mu m^2$) | 28800 |
| % Porosity | 15.8 |
| Total Metal ($\mu m^2$) | 24250 |
| % Ni undiffused | 55.93 |

TABLE 12

Diffusion calculations for steel blend with T110 nickel powder

| Ni-rich area | % Ni | $\mu m^2$ total | $\mu m^2$ Ni | Particles/Ni-rich area |
|---|---|---|---|---|
| 1 | 6.8 | 56 | 4 | 2.12 |
| 2 | 2.4 | 80 | 2 | 1.07 |
| 3 | 9.1 | 36 | 3 | 1.82 |
| 4 | 16.7 | 160 | 27 | 14.84 |
| 5 | 11.4 | 32 | 4 | 2.03 |
| 6 | 7.2 | 208 | 15 | 8.32 |
| 7 | 4.3 | 32 | 1 | 0.76 |
| 8 | 10.5 | 104 | 11 | 6.07 |
| 9 | 3.6 | 32 | 1 | 0.64 |
| 10 | 4.7 | 56 | 3 | 1.46 |

| | |
|---|---|
| Field ($\mu m^2$) | 28800 |
| % Porosity | 10.0 |
| Total Metal ($\mu m^2$) | 25920 |
| % Ni undiffused | 13.59 |

Testing was conducted at 1120° C. for 5 minutes (1065° C.), 30 minutes, 60 minutes and 120 minutes. Table 13 below shows mean % undiffused Ni from three fields.

TABLE 13

| | % undiffused Ni in sintered FN-0205 | | | |
|---|---|---|---|---|
| Sample | 5 minutes | 30 minutes | 60 minutes | 120 minutes |
| FN0205/T110 | 37% | 22% | 1.0% | 0.2% |
| FN0205/T123 | 84% | 35% | 18.1% | 0.7% |

The results from 5 minutes of sintering may be misleading because of the better overall distribution seen from T110 powder. Near complete diffusion of nickel into iron is possible with extended sintering times at standard sintering temperatures.

It could be reasonably extrapolated that using higher temperature (1250° C.) may cause the extra-fine nickel to be completely diffused into iron in a significantly reduced time. This is based on the fact that diffusion increases exponentially with temperature.

Overall, the results demonstrate that improvements in blend properties, green properties and as-sintered properties are now possible by addition of hydrophobic fumed silica to the T110 nickel powder. A hydrophobic inorganic dispersent such as fumed silica does indeed inhibit the formation agglomerations, as well as, break apart existing agglomerates.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

What is claimed is:

1. A reduced agglomerating nickel-base additive for powder metallurgy steel and alloy compounds made by the process comprising:

a) providing extra-fine nickel powders, b) providing a non-aqueous hydrophobic inorganic dispersant, the hydrophobic inorganic dispersant selected from the group consisting of metal oxides, carbides and nitrides, and having a particle size between about 10 nm and 500 nm and a surface area greater than about 200 $m^2/g$, and ranging from about 0.25 to 0.5% by weight 2of nickel, and c) mixing the fine nickel powders and the non-aqueous hydrophobic inorganic dispersant under low shear conditions.

2. The additive according to claim 1 wherein the non-aqueous hydrophobic inorganic dispersant is fumed silica.

3. The additive according to claim 2 wherein the non-aqueous hydrophobic inorganic dispersant includes a silicon compound.

4. The additive according to claim 3 wherein the silicon compound is a silane agent.

5. The additive according to claim 4 wherein the silane agent is selected from at least one member of the group consisting of nexamethyldisilazane and trimethoxysilane.

6. The additive according to claim 1 wherein the extra-fine nickel powder has a mean particle size distribution d50 of about 1.5 μm.

7. The additive according to claim 1 including mixing the extra-fine nickel powder with iron and carbon and the non-aqueous hydrophobic inorganic dispersant.

8. The additive according to claim 1 including mixing is performed for between about 20–80 minutes in a low shearing apparatus.

9. A method for making a powder metallurgy product while reducing agglomeration therein, the method comprising:

a) providing extra-fine nickel powder, b) providing a non-aqueous hydrophobic inorganic dispersant, c) mixing the extra-fine nickel powder with the hydrophobic inorganic dispersant under low shear conditions to form a reduced agglomerating powder metallurgy additive, and d) mixing the reduced agglomerating powder metallurgy additive with a powder metallurgy steel or alloy composition to make the powder metallurgy product.

10. The method according to claim 9 wherein the non-aqueous hydrophobic inorganic dispersant is selected from at least one member of the group consisting of metal oxides, carbides and nitrides.

11. The method according to claim 9 wherein the non-aqueous hydrophobic dispersant includes a silicon compound.

12. The method according to claim 11 wherein the non-aqueous hydrophobic dispersant includes fumed silica.

13. The method according to claim 11 wherein the silicon compound is a silane agent.

14. The method according to claim 13 wherein the silane agent is selected from at least one member of the group consisting of nexamethyldisilazane and trimethoxysilane.

15. The method according to claim 9 wherein the non-aqueous hydrophobic inorganic dispersant has a particle size between about 10 nm and 500 nm and has a surface area greater than about 200 $m^2/g$.

16. The method according to claim 9 wherein the extra-fine nickel powder has a mean particle size distribution d50 of about 1.5 μm.

17. The method according to claim 9 wherein the non-aqueous hydrophobic inorganic dispersal ranges from about 0.25 to 0.5% by weight of nickel.

18. The method according to claim 9 including mixing the extra-fine nickel powder with iron and carbon and the non-aqueous hydrophobic inorganic dispersant.

19. The method according to claim 9 including pressing the powder metallurgy alloy product and sintering the pressed alloy product.

20. The method according to claim 9 wherein mixing is performed for between about 20–80 minutes in a low shearing apparatus.

* * * * *